US006065415A

United States Patent [19]

Orr

[11] Patent Number: 6,065,415

[45] Date of Patent: May 23, 2000

[54] REDUCTION OF WAVE MAKING BY MULTI-HULL SURFACE VESSEL

[76] Inventor: Anthony Hugh Orr, 10 Hien St., Totnes, Devon TQ9 5RY, United Kingdom

[21] Appl. No.: 08/525,075

[22] Filed: Sep. 8, 1995

[30] Foreign Application Priority Data

Dec. 1, 1994 [GB] United Kingdom ..... 9424272

[51] Int. Cl.[7] ..... B63B 1/12

[52] U.S. Cl. ..... 114/61

[58] Field of Search ..... 114/61, 126, 283, 114/123; D12/304

[56] References Cited

U.S. PATENT DOCUMENTS

| | | | |
|---|---|---|---|
| 2,464,957 | 3/1949 | Wood | 114/61 |
| 2,972,322 | 2/1961 | Parker et al. | 114/126 |
| 3,004,510 | 10/1961 | Nawara | 114/126 |
| 3,296,992 | 1/1967 | Lackenby | 114/61 |
| 4,086,863 | 5/1978 | Nitzki et al. | 114/61 |
| 4,562,784 | 1/1986 | Lineback | 114/61 |

FOREIGN PATENT DOCUMENTS

| | | | |
|---|---|---|---|
| 798639 | 11/1968 | Canada | 114/126 |
| 483948 | 5/1992 | European Pat. Off. | 114/61 |

*Primary Examiner*—Ed L. Swinehart

[57] ABSTRACT

A multi hulled vessel in which its two outermost hulls are parallel and have a configuration such that one hull is a mirror image of the other and are double ended, each hull is characterized by its stern part; beneath the waterline in which there is a continuation to the stern of the hulls bottom and one side surface without aftward convergence to the waterline or the fore and the aft axis, and in which the hulls other side surface converges towards the two said surfaces.

3 Claims, 5 Drawing Sheets

REDUCTION OF WAVE MAKING BY MULTI-HULL SURFACE VESSEL

BACKGROUND

The invention relates to vessel's of catamaran, trimaran and the slender integrated catamaran form that employ hulls one on each side of the vessels centre line symmetrically arranged and that these hulls taper aftwardly in their underwater stern part. It is well known that hulls of this shape and in the light/medium displacement category experience a disproportionately large increase in drag if high speeds are attempted. This resulting from the maintenance of a continuous waterflow over the hull's stern part.

A hull form that creates the condition for air to be introduced to the otherwise submerged tapering aft hull surface and thereby the cessation of the continuous flow of water is already known.

In operation at sea this type experiences the re-establishment of continuous water flow and the obligatory increase in drag. This occurs when heeled, and rolling.

SUMMARY OF INVENTION

According to the present invention there is provided a multi hulled vessel in which its two outer most hulls are parallel and double ended, where—in one hull has a bow that displaces water at least to the right of its fore and aft axis and is at least asymmetric in its aftward part when viewed in plan at the datum waterline; beneath the waterline and in schematic representation, that part of the hull aftward of the divergent bow comprises a right and left side surface and a bottom surface such that each surface is an aftward continuation of its respective bow and in particular that the right side surface and bottom surface continues aftwardly from their widest beam at that depth beneath the waterline without convergence to the fore and aft axis nor appreciable convergence to the datum waterline, and terminate in the most aftward athwartships plane of the datum waterline; to satisfy the criteria of a convergent stern part the cross sectional area of the hull must at successive aftward locations reduce, so the aforesaid left side surface being of undetermined shape converges towards the said right side surface and or bottom surface so that at the aft termination of all three said surfaces cross sectional area of the hull is considerably reduced from that at the hulls maximum cross sectional area.

MODE OF OPERATION

In operation the water particles displaced by the bow of each hull will follow streamlines that pass aftward along the hull. Along the hulls right side surface and its bottom surface these particle streamlines do not converge either inwardly to the fore and aft axis of the hull when viewed in plan, nor aftwardly upward in elevation. It is only along the aftwardly convergent left side surface of the hull that the particle streamlines converge aftwardly. This convergence of the water particles is between those particles passing along the hulls right side and bottom surface and those having passed along the hulls left side surface. At slow speed the particles have plenty of time in which to re-arrange their lateral position along the hull's aftwardly convergent left side surface. With increasing hull speed that time for re-arrangement decreases. This results in a reduction of the water flowing along the full length of the convergent stern surface. The inertia of water particles can only be utilised in this manner by the introduction of air, together with the restriction of the source of available water to that laterally and adjacently outward of the convergent stern part. It has been shown in practise that the level of water in contact with the hulls convergent stern part decreases in direct ratio to the increase in speed. Eventually the afwardly convergent left side surface is without water. This is achieved without the need of either changing the hulls longitudinal angle of trim, or any change in the level of the hull's centre of gravity from the position when the hull is stationary. This flow separation occurs at a considerably lower hull speed than any reduction in drag likely to occur from an increase in the dynamic pressure experienced along the hull's underside.

In general the particle streamlines on surfaces other than the aftwardly convergent left side surface pass aftwardly along the hull until astern of it's transom, without substantial convergence.

ADVANTAGES

It is expected that a considerable reduction in hull drag will be possible by the use of this new technique of flow separation made possible by the invention. The wash generated by the stern will be considerably reduced compared to that produced by a traditional vessel of similar weight, length and beam.

When sailing the vessel will take an angle of heel to leeward and when rolling air will not be prevented from accessing the convergent left side surface. This is ensured by using two identical hulls one being a mirror image of the other and arranged such that their aftwardly convergent stern surfaces are inward facing to the vessels centre line.

The term convergent stern surface applies to the hulls left side surface in the stern part of the schematic representation.

MODE OF THE OPERATION

In operation the water particles displaced by the bow of each hull will follow streamlines that pass aftward along the hull. Along the hulls right side surface and its bottom surface these particles streamlines do not converge either inwardly to the fore and aft axis of the hull when viewed in plan, nor aftwardly upward in elevation. It is only along the aftwardly convergent left side surface of the hull that the particle streamlines converge aftwardly. This convergence of the water particles is between those particles passing along the hulls right side and bottom surface and those having passed along the hulls left side surface. At slow speed the particles have plenty of time in which to re-arrange their lateral position along the hull's afwardly convergent left side surface. With increasing hull speed that time for re-arrangement decreases. This results in a reduction of the water flowing along the full length of the convergent stern surface. The inertia of water particles can only be utilised in this manner by the introduction of air, together with the restriction of the source of available water to that laterally and adjacently outward of the convergent stern part. It has been shown in practise that the level of water in contact with the hulls convergent stern part decreases in direct ratio to the increase in speed. Eventually the afwardly convergent left side surface is without water. This is achieved without the need of either changing the hulls longitudinal angle of trim, or any change in the level of the hull's centre of gravity from the position when the hull is stationary. This flow separation occurs at a considerably lower hull speed than any reduction in drag likely to occur from an increase in the dynamic pressure experienced along the hull's underside.

In general the particle streamlines on surfaces other than the aftwardly convergent left side surface pass aftwardly along the hull until astern of it's transom, without substantial convergence.

ADVANTAGES

It is expected that a considerable reduction in hull drag will be possible by the use of this new technique of flow separation made possible by the invention. The wash generated by the stern will be considerably reduced compared to that produced by a traditional vessel of similar weight, length and beam.

When sailing the vessel will take an angle of heel to leeward and when rolling air will not be prevented from accessing the convergent left side surface. This is ensured by using two identical hulls one being a mirror image of the other and arranged such that their aftwardly convergent stern surfaces are inward facing to the vessels centre line.

The term convergent stern surface applies to the hulls left side surface in the stern part of the schematic representation.

DESCRIPTIONS OF PREFERRED EMBODIMENT

Figure 1:
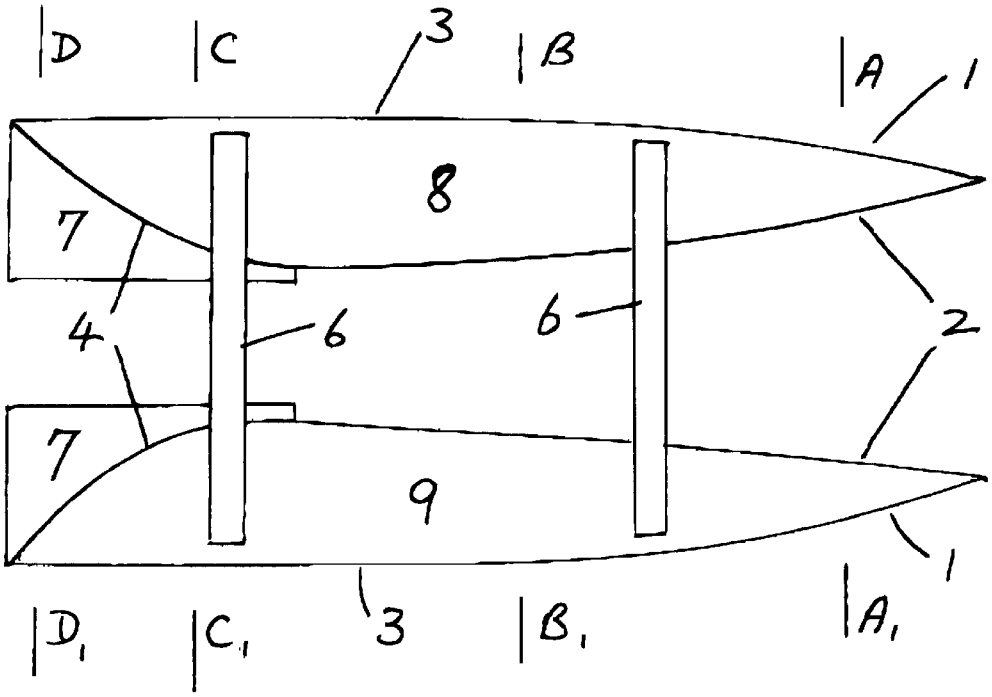
FIG. 1 is a plan view of an embodiment of the invention in the form of a catamaran in schematic representation.

Referring to FIG. 1. In this drawing the catamaran is constructed using two mirror image float hulls 8 and 9 joined by a bridging means 6. In conjunction with FIG. 2 FIG. 3 FIG. 4 FIG. 5 the essential parts being a divergent bow surface 1 and 2 on at least the inward medial surface 2, a bottom hull surface 5 which in elevation shows this bottom surface to have substantially horizontal buttock lines, (the line of intersection of a vertical longitudinal plane within the stern section at the bottom surface).

The outer surface 3 of each hull does not converge aftwardly relative to the fore and aft axis of the vessel when viewed in plan. The inward facing convergent stern surface 4 does in plan view converge towards the said outer surface 3 or it's waterguide and or converge to the bottom surface 5 or it's waterguide 7. The three said surfaces or waterguides co-terminate in the most aftwardly athwartships plane that contains the datum waterline.

Figure 6:
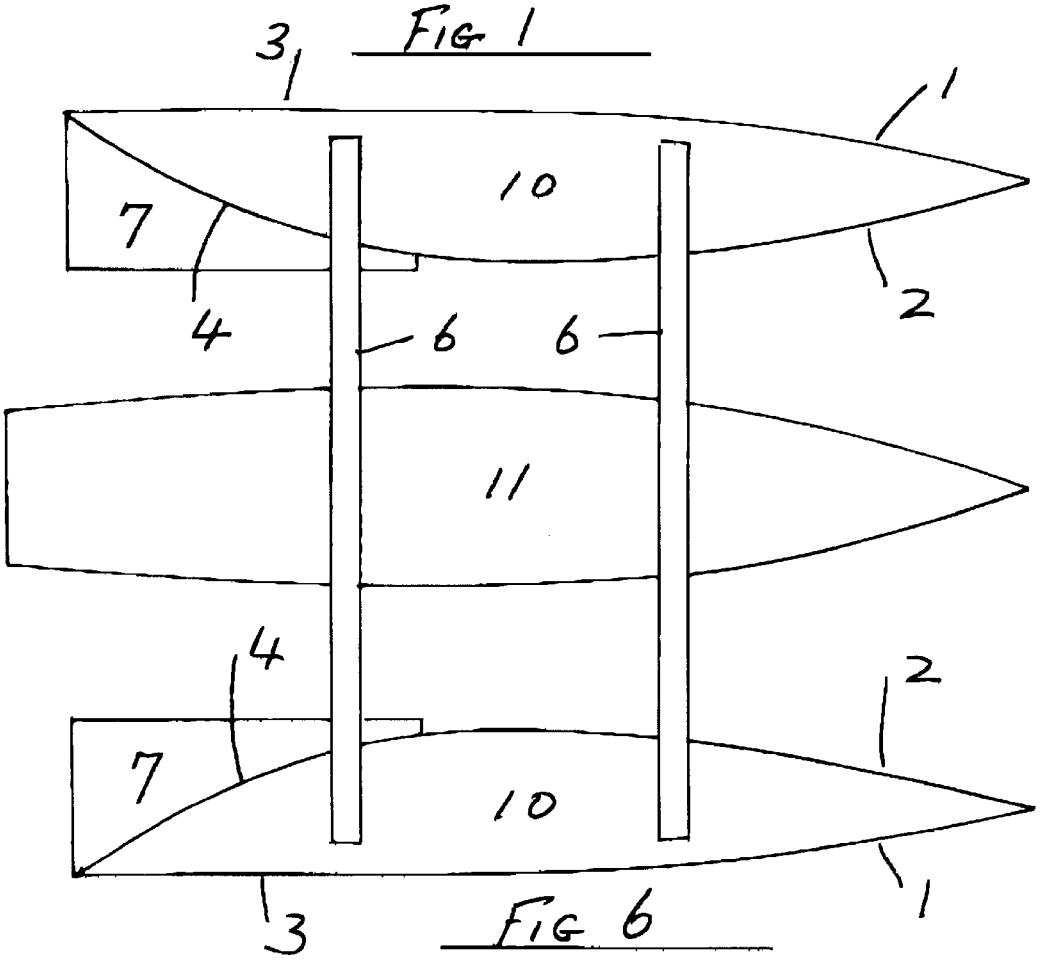
FIG. 6 is a plan view of an embodiment in the form of a trimaran drawn in schematic representation.
Figure 2:
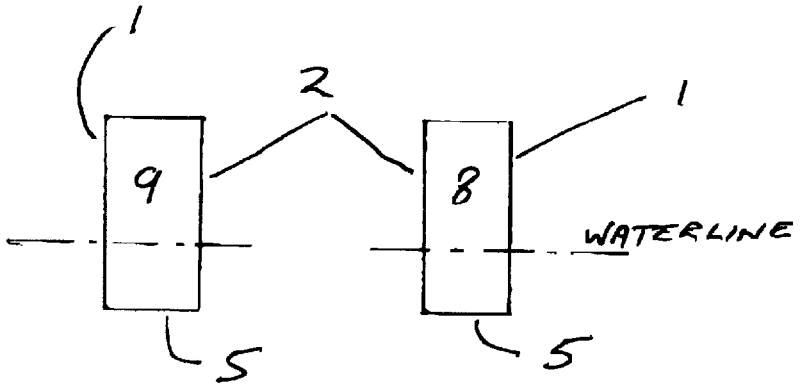
FIG. 2 shows that cross section of FIG. 1 at A—A.
Figure 3:
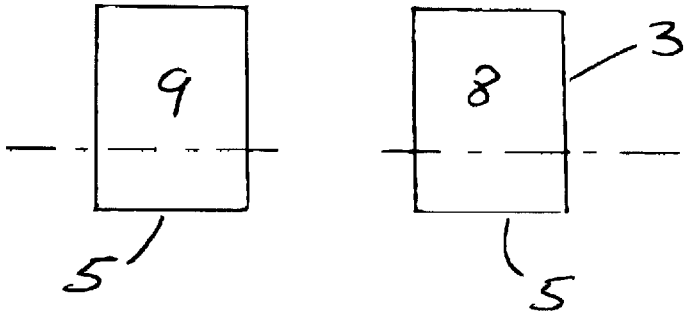
FIG. 3 shows that cross section of FIG. 1 at B—B.
Figure 4:
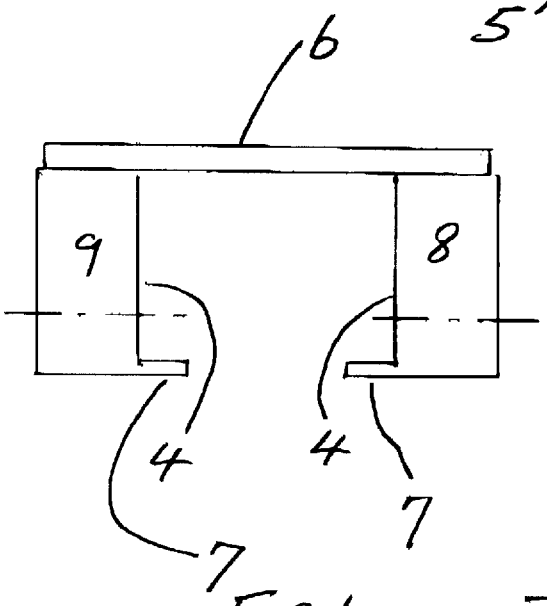
FIG. 4 shows that cross section of FIG. 1 at C—C.
Figure 5:
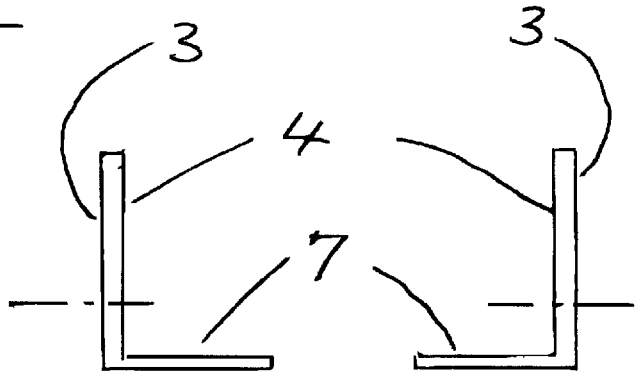
FIG. 5 shows that cross section of FIG. 1 at D—D.
Figure 7:
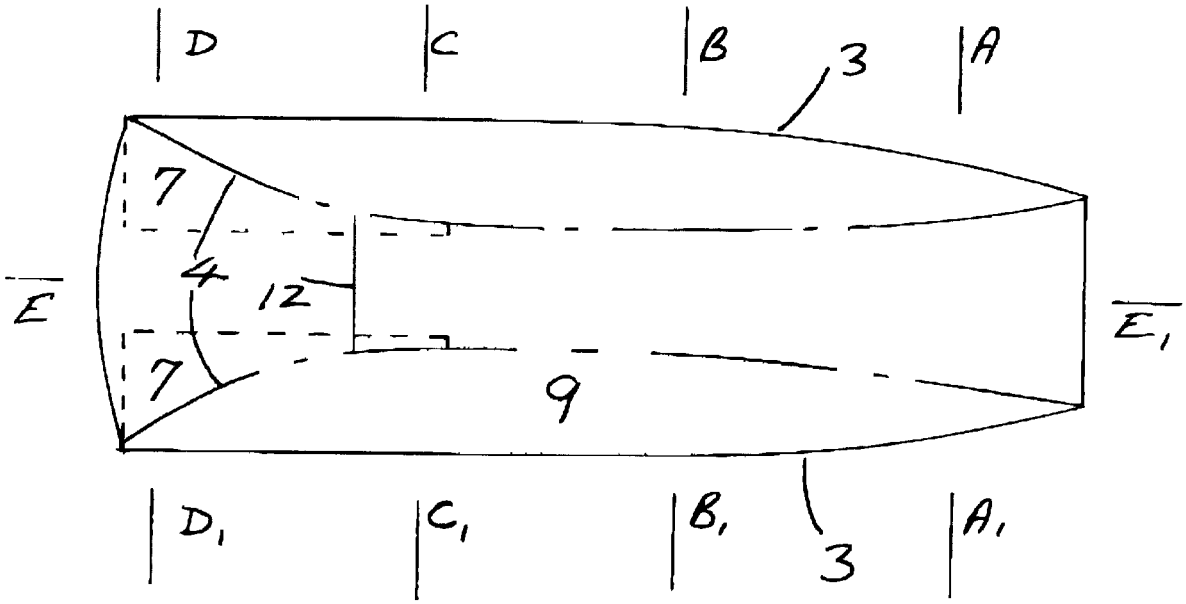
FIG. 7 is a plan view of a type of slender catamaran incorporating an integral bridge structure.
Figure 8:
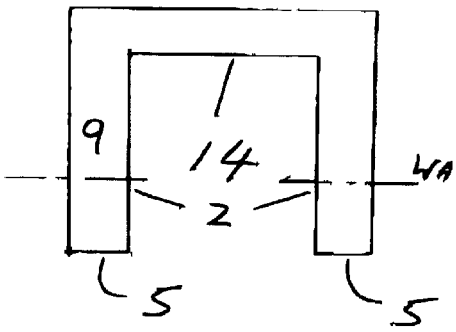
FIG. 8 shows that cross section of FIG. 7 at A—A.
Figure 9:
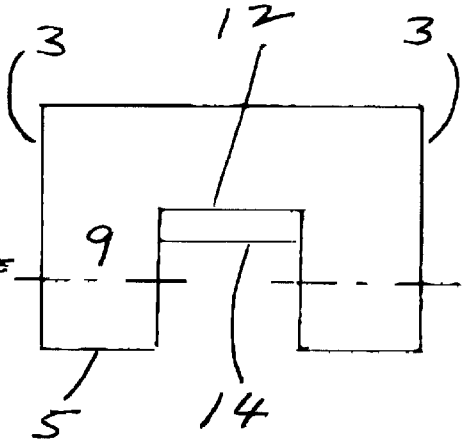
FIG. 9 shows that cross section of FIG. 7 at B—B.
Figure 10:
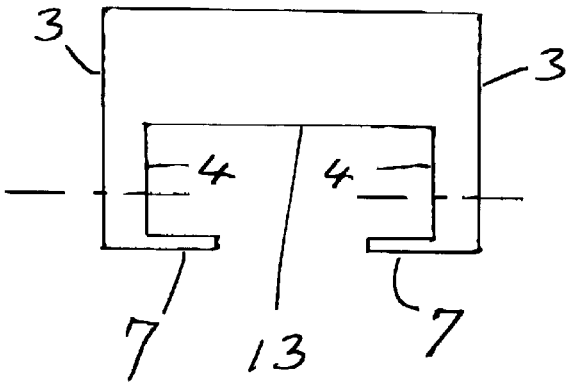
FIG. 10 shows that cross section of FIG. 7 at C—C.
Figure 11:
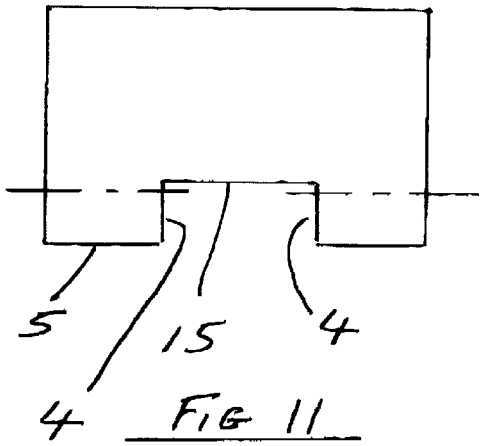
FIG. 11 shows that cross section of FIG. 7 at D—D.
Figure 12:
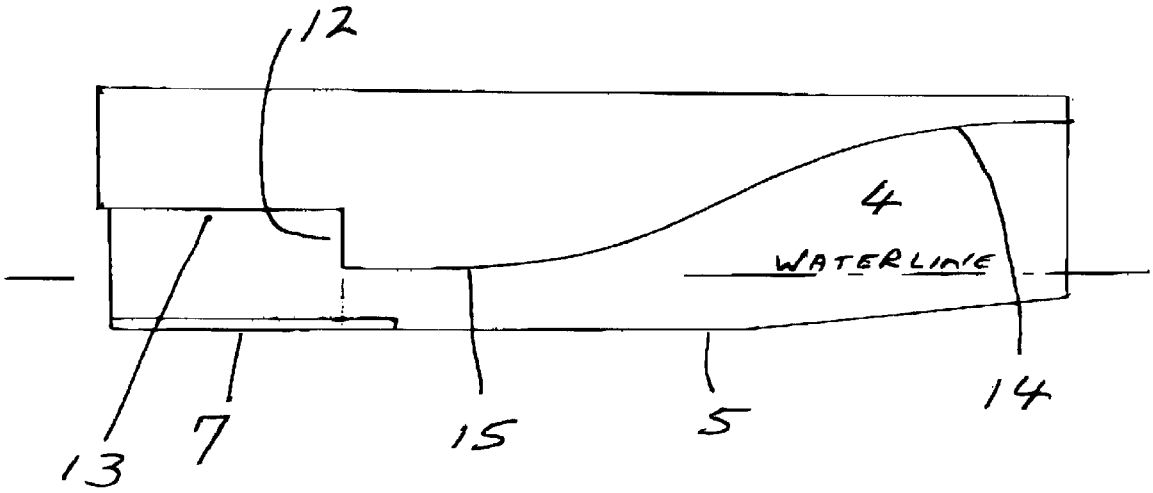
FIG. 12 shows that elevation of 13 FIG. 7 at E—E.
Figure 13:
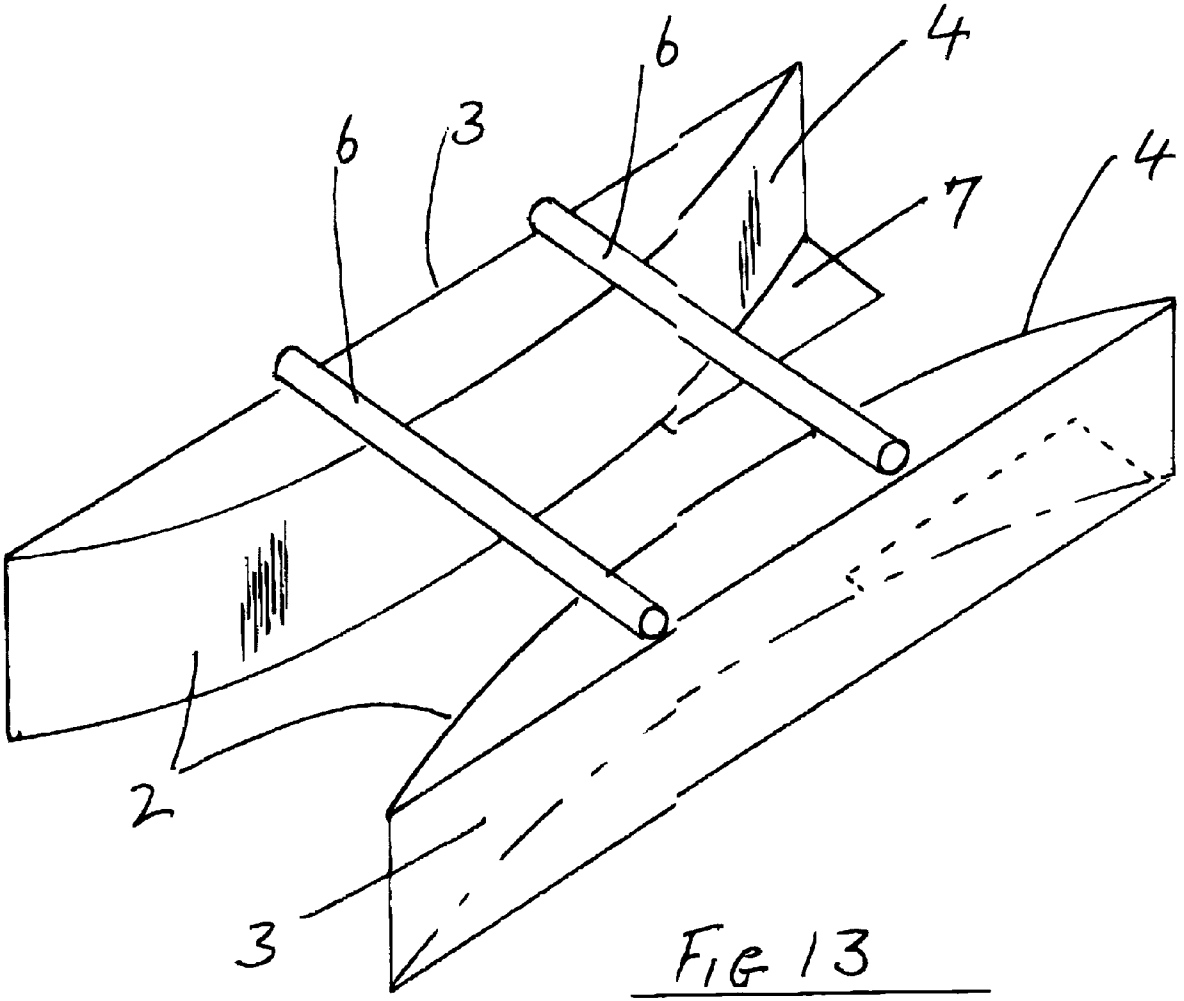
FIG. 13 shows a further preferred embodiment of a catamaran in perspective projection.

FIG. 6 is a drawing in plan view of a trimaran in which the two outer hulls are a mirror image configuration of the other with their divergent bow surfaces 1 and 2 on at least the inward facing side 2. Also shown are aftwardly convergent inward facing surfaces 4 and bottom waterguides 7 and the bridging structures 6. The central main hull 11 when the vessel is not heeled the two hulls will be suspended slightly above or adjacent the water surface. At least part of the time during normal operation one hull will be immersed in addition to the central hull.

FIG. 7–12 inclusive are of preferred embodiment having the bridging structure 13, 14 and 15 joining the two float hulls 9 along their inward surfaces as an integral part of the two hulls, this greatly increases the useable internal capacity of the vessel. Forwardly the bottom of the bridge structure 14 may be inclined upwardly, but decreases in height above the water aftwardly.

The configuration of the hulls in cross-section may be by means of curves or straight lines.

To ensure aftward continuity of shape the waterguides should be of rigid construction. The hulls however could be constructed in tubes or shapes of inflated flexible material of the type in common marine use. It is desirable that in whichever configuration or mode of construction, the most inward edge of waterguide should extend at least to the perpendicular of the datum waterline in that location. In preference this bottom waterguide should in cross section have it's outer most edge at the greatest depth below the water surface and be horizontal athwartships.

The exact shape of the hulls convergent left side surface is undetermined and may converge towards either the hulls right side surface, or the hulls bottom surface simultaneously, or at different rates.

Where the rates of convergence are dissimilar it will be necessary to continue a part of that bottom or side surface to its normal aft most point of termination with the use of a plate. This plate being simply a means of continuing the function of the hulls outer shape and keeping the two water flows, that over non-convergent and convergent aft surfaces seperate until astern of the transom.

I claim:

1. A multi-hull watercraft including at least two hulls, said hulls being parallel to each other and having a maximum beam at a mid-point thereof, the two outermost hulls thereof being asymmetric at least in the stern portions, and being essentially mirror images of each other, said two outermost hulls including inner, outer and bottom sides, said outer sides being generally parallel to each other aft of said mid-portion of each hull, and said bottom sides being generally parallel to the waterline in elevation at least aft of said mid-portion, said inner sides of said hulls converging towards said outer sides aft of said mid-portion, said inner and outer sides of each outermost hull meeting at the stern, and a plate attached to each hull forming a continuation of the bottom sides thereof, each said plate extending from the stern to approximately said mid-portion of the hull, and at the stern exhibiting a width generally as that of the hulls at said mid-portion, inner edges of said plates being generally parallel to each other and the outer sides.

2. A multi-hull watercraft as set forth in claim 1, in which each of said at least two hulls has a datum waterline, and each said plate extending laterally inwardly at least to a vertical of the datum waterline.

3. A multi-hull watercraft as set forth in claim 2, in which each of said plates extending laterally inwardly beyond the vertical of the datum waterline.

* * * * *